US005572846A

United States Patent [19]

Sosa

[11] Patent Number: 5,572,846

[45] Date of Patent: Nov. 12, 1996

[54] POSTER RESISTANT POLE

[75] Inventor: Jesus M. Sosa, Rio Piedras, Puerto Rico

[73] Assignee: Sosa Architectural Metal Corporation, Puerto Rico

[21] Appl. No.: 381,440

[22] Filed: Jan. 31, 1995

Related U.S. Application Data

[63] Continuation-in-part of Ser. No. 16,106, Dec. 7, 1993, Pat. No. Des. 357,988.

[51] Int. Cl.[6] ..... E04C 3/30

[52] U.S. Cl. ..... 52/736.4; 52/736.3; 52/737.4; 52/737.5; 52/723.1; 52/723.2; 40/594; 256/1

[58] Field of Search ..... 52/736.3, 736.4, 52/737.4, 737.5, 723.1, 723.2; 116/173–175; 174/45 R; 40/594; 256/1

[56] References Cited

U.S. PATENT DOCUMENTS

| | | | |
|---|---|---|---|
| 202,373 | 9/1965 | Schrang | D48/31 |
| 909,299 | 1/1909 | Hilborn et al. | 52/736.3 X |
| 2,989,789 | 6/1961 | Cohn | 52/736.3 X |
| 3,793,794 | 2/1974 | Archer et al. | 52/632 |
| 3,934,879 | 12/1975 | Wright | 40/594 X |
| 4,090,464 | 5/1978 | Bishopp et al. | 40/594 X |
| 4,242,851 | 1/1981 | Pohlman et al. | 52/743 |
| 4,244,156 | 1/1981 | Watts, Jr. | 52/736.4 X |
| 4,878,160 | 10/1989 | Reneau et al. | 362/269 |
| 4,961,258 | 10/1990 | Menzel | 52/737.4 |
| 5,048,229 | 9/1991 | Campbell | 52/736.4 X |

*Primary Examiner*—Carl D. Friedman
*Assistant Examiner*—W. Glenn Edwards
*Attorney, Agent, or Firm*—Eckert Seamans Cherin & Mellott

[57] ABSTRACT

A poster resistant utility pole, light standard, sign pole or the like has protruding structures such as splines or ribs that decrease the surface area available for contact with adhesive posters and handbills, as compared to a smooth surface. Posters can be attached insecurely at most, because the accessible area is limited to the ends of the protruding structures. Posters that are attached are easily removed leaving minimal remnants, for example by passing a rake-like tool or one's fingers through channels between the ribs. The ribs can protrude radially and extend longitudinally from the surface of a solid or hollow cylindrical pole or other shape, or can be provided on a sheath for a pole over a limited height, such as from the ground to a height above the reach of an average person.

22 Claims, 3 Drawing Sheets

POSTER RESISTANT POLE

This application is a continuation in part of design patent application Ser. No. 29/016,106, filed Dec. 7, 1993, now U.S. Pat. No. Des. 357,988.

Background of the Invention

1. Field of the Invention

The invention relates to the surface configuration of poles, posts, support structures and the like, for example that support signage, outdoor lighting, telephone or power transmission lines, elevated roadways and the like in public places. In particular the invention provides a surface structure that presents a minimal outermost surface area, especially using elongated radially protruding splines, such that posters and handbills cannot be securely or permanently attached.

2. Prior Art

Support poles are used, for example, to support utility lines such as telephone, cable television and electric power lines, various types of lighting fixtures, traffic signals, signage, elevated roadways or tracks and the like. The familiar "telephone pole" typically is cylindrical in shape and ranges in exposed length above the ground from 18 to 25 feet (5.5 to 8 meters) and in diameter from eight inches to a foot (20 to 30 cm.). Poles and similar supports are popular sites for affixing posters, handbills and similar materials.

Square or other cross sections are also possible for supports, and supports with flat surfaces (e.g., bridge abutments) may also be used for the attachment of posters and other sheet materials. Supports of this nature vary in size and shape depending on the load they are expected to carry and depending on the height of the pole or support. Therefore a given pole can be larger or smaller than the typical telephone pole. For purposes of convenience, all such poles and supports are described herein using the example of utility poles, although the invention is not limited to poles or posts for any particular use, and instead concerns the improvement of poles and other supports to render their surfaces less suitable for the mounting of posters.

Although it is very common to have a solid utility pole or other support made of treated wood, one end being buried in the ground, an increasing number of utility poles and supports are constructed using other materials and structures, such as metal or plastic poles received in a base structure that can be bolted down rather then buried. It is advantageous to provide support poles that are inexpensive, long lived and easy to install and maintain. In some instances, a pole advantageously includes break away mounts for minimizing damage to vehicles and injuries to occupants that may collide with the pole, means to telescope a pole or to articulate it for access to the upper section or for orienting the upper section as needed. Poles may also include various devices for attachment to the ground, including wiring access arrangements, resilient mountings so that minor collisions only temporarily deflect the pole, etc. Many of these features are advantageously provided with a metal or plastic pole, such as an extruded aluminum pole.

Ground mounted utility poles and supports inherently have at least a portion of their length readily accessible to people on the ground. Such people often wish to post signs, posters, placards, banners, stickers, advertisements and the like. Particularly over time, in well travelled areas where posters are popular, and as older posters deteriorate and are covered over by newer ones, the pole or support can become quite unsightly. This is a particular problem in urban areas.

Most common utility poles and supports have a smooth outer surface. It is easy to relatively permanently attach a poster to such a surface using glue, cement, paste, tape the like. Even assuming that maintenance personnel regularly remove posters and bills, this is time consuming and expensive, and it is often difficult to remove them completely without undertaking major operations such as chemical cleaning or abrasion. It would be desirable to produce a pole or support that is resistant to affixation of posters initially, and/or a pole that permits attached posters to be removed easily and relatively completely without leaving bits and pieces of poster and adhesive behind. Preferably, the poster resistant surface can also be applied to existing poles and supports.

One possibility would be to coat the poles with a non-stick material, for example similar to that used in cookware, or perhaps including grease or a similar lubricant or release coating. These coatings may be expensive or may not weather well outdoors. Insofar as the coating may be visible or may accumulate dirt, the coating would be unsightly in itself.

It would be desirable to provide a utility pole that is structurally and permanently resistant to the affixation of posters, is strong and attractive but relatively inexpensive,. can be readily made in modern materials, and from which any posters attached by particularly tenacious persons can be readily and substantially completely removed.

The present invention provides such a structure by minimizing the surface area available at the outer periphery of the pole for a poster to contact. This can be accomplished by using relatively thin protruding longitudinally extending splines or similar structures. It is known to provide decorative surface configurations in poles that arguably form splines, especially in poles intended to resemble historical cast poles. However, such decorative structures lack protrusions that present exclusively a minimal surface area at their radially outermost edges, that are sufficiently deep and/or closely spaced as to practically prevent posters, bills and the like from being attached effectively, and/or to facilitate their removal.

SUMMARY OF THE INVENTION

It is an object of the invention to produce a pole or similar support having an external structure that inherently interferes with the adhesive attachment of sheet materials, thereby discouraging attempts to attach such materials as well as facilitating their removal.

It is another object of the invention to produce a pole having longitudinally extending radially protruding structures such as splines, ribs or the like, the outermost edges of which present substantially less surface area than would a smooth surface at the same position.

It is also an object to arrange the radially protruding structures to define sufficient depth and/or to be sufficiently closely spaced, that either a poster cannot effectively be attached to the sides and bottoms of channels defined med between the protruding structures, or if a poster (e.g., of thin flexible material) can be so attached, that the appearance of the poster is substantially spoiled.

It is another object of the invention to produce poster resistant structures as described, that can be attached to the exterior of a smooth surface pole, or can attach to a longitudinally adjacent section of pole disposed out of convenient reach.

It is another object of the invention to a produce poster resistant sheath with longitudinally extending and protruding structures such as splines, ribs or the like, the outermost edges of which present substantially less surface area than would a smooth surface.

It is a further object to arrange such a structure to facilitate the flow of water behind an attached poster, for example by forming vertical channels.

It is another object of the invention to produce a poster resistant sheath that can be attached to existing exterior surfaces, flat, curved or otherwise.

It is yet another object of the invention to provide a pole that is attractive and strong, using a minimum of material to achieve structural strength.

These and other objects are accomplished by a support such as a pole, or a sheath for a support, having protruding structures on an outer surface, that present a minimal surface area facing outwardly and are spaced sufficiently close to limit surface contact with a sheet such as a poster, to the area facing radially outwardly. Preferably, the support, pole or sheath comprises longitudinally elongated protruding ribs or splines spaced evenly around the outer surface. The ribs can be provided along the entire pole or only over an area to be made resistant to the attachment of posters, handbills and the like, e.g., from a base of the pole to a height above the reach of an average person (e.g., 3 meters). The ribs or splines prevent secure attachment of adhesive backed signs and the like, or make such signs easy to remove, by breaking up the otherwise continuously smooth surface of a typical cylindrical pole and limiting the available adhesive bonding area to a small percentage of the circumference, e.g., less than 20%. The ribs can have radial sidewalls or inclined sidewalls to form truncated triangles in section, e.g., the sidewalls being inclined between 60° and 90° to a tangent.

The pole or pole sheath and its ribs are formed out of a rigid material such as metal or plastic and can be extruded. As a pole sheath, the device can be attached around a pole structure having a material that could be punctured by nails or staples (e.g., a wooden utility pole). The rigid sheath material thus makes the pole resistant to the attachment of posters and handbills by nails or staples as well as adhesives. The ribs aid in removal of any attached sheet materials in that the security of such attachment is limited by limitation of the available surface area and the rib structure allows fingers or a tool to be slid along the spaces between adjacent ribs to pry or tear the sheet materials from the pole.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
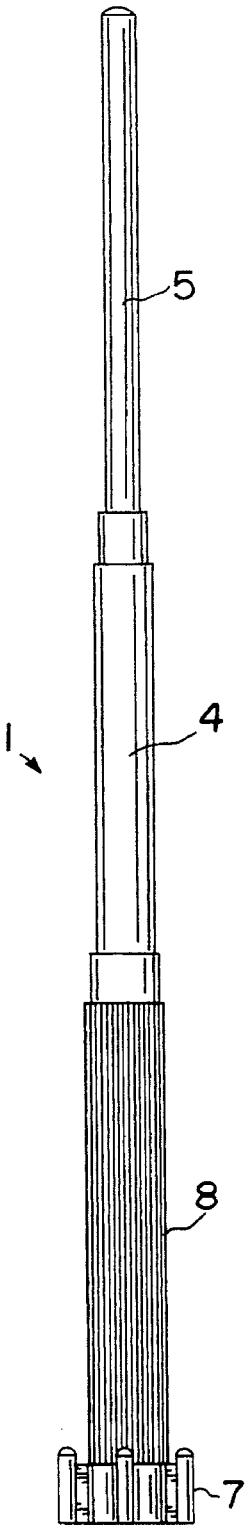
FIG. 1 is a front elevation view of the poster resistant pole or pole sheath of the invention.

FIG. 1 shows a utility pole 1 in accordance with a preferred embodiment of the invention. Pole 1 could be, for example, a street sign support, a support for a lighting fixture, a traffic signal support, a support leg for a structure and so on. The pole shown has a basically cylindrical profile and tapers stepwise from the base to the tip. The invention is likewise applicable to poles having other cross sections and to flat surfaces subject to the attachment of posters.

The support member has a base 7 with bolt receptacles or the like for mounting or anchoring the pole in an upright position. A poster resistant portion 8 extends longitudinally from base 7 to a height above the reach of an average person (e.g., 3 meters). Of course it is also possible to extend the structure of the poster resistant section over the entire length of the support member or to use a different profile other than round, such as rectangular, hexagonal or some other geometric shape.

The support member can taper from the base upwardly, and is divided into three portions, lower section 3 (FIG. 2), middle section 4 and upper section 5. The sections 3–5 are coaxial with each other and can be coupled end to end, telescoped over a limited length, or placed coaxially over one another along their full length. The poster resistant or non-stick section 8 can be provided by a sheath that is coupled to the lower portion coaxially with the support member. It is apparent to those skilled in the art that non-stick section can be applied to support members that do not taper as well as support members that taper in a continuous fashion (i.e., without distinct steps).

Figure 2:
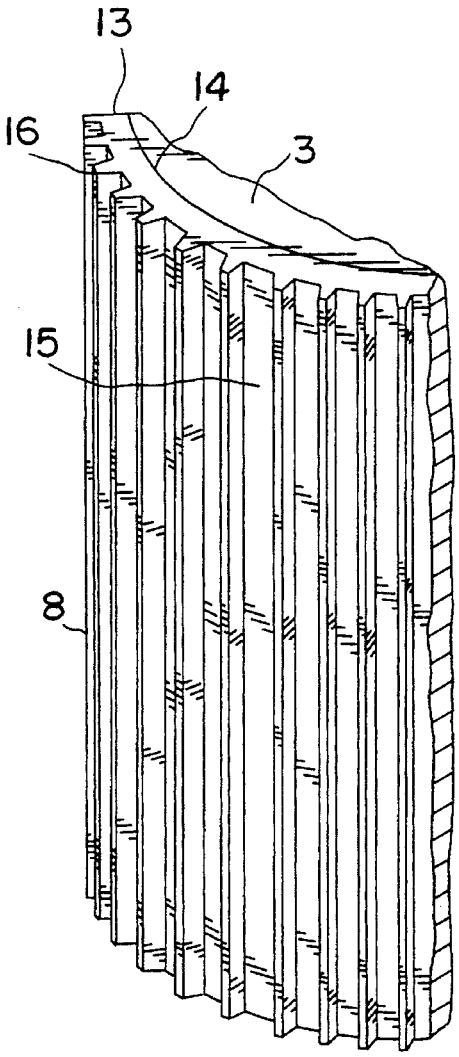
FIG. 2 is an enlarged perspective segment showing a section of the poster resistant pole.

As shown in FIG. 2, the non-stick section has a curved backing plate 13 with a concave inner surface 14 facing against the outer surface of the support member. Backing plate 13 also has a convex outer surface 15 having longitudinal ribs 16 facing radially outwardly. The ribs as shown in FIG. 2 have a trapezoidal truncated triangular profile. Other profiles such as rectangular, triangular and semi-circular could be used as well, provided the ribs reduce the surface area along the outer circumferential edge to provide a minimal area against which the adhesive of a poster or handbill can bond. Each of the individual ribs in FIG. 2 are shown as being continuous along the entire length of the non-stick portion. It is apparent to those skilled in the art that the protruding structures for minimizing the outer surface area also can be discontinuous, for example with regular blocks forming a pincushion, rather than continuous longitudinal ribs or splines.

The poster resistant section can be formed out of rigid material such as metal or plastic, e.g., extruded in indefinite lengths and cut to the length required. Additionally the poster resistant section can be coated or impregnated with a non-stick coating such as silicone, Teflon or the like, at least on the radially outermost surfaces of the ribs.

The poster resistant section can be used as a structural member of the utility pole, or can be used as a supplemental protective shell over an otherwise self-supporting pole or structure. The rigid material is sufficiently hard so as to resist breakage and punctures, and accordingly can provide a protective poster-resistant shell around a material such as a wooden pole, subject to nails, tacks or staples. In that case, both adhesive and penetrating fastening means are thwarted.

It would be possible to minimize the outer surface area to virtual knife edges, or in a discontinuous embodiment to reduce the outer area to the ends of relatively sharp spikes. However the invention is helpful to discourage the attachment of posters provided the surface area is simply reduced to less than would be available on a smooth cylinder. Of course it is not possible to reduce the outer surface area to zero. In the event unauthorized materials become attached notwithstanding the minimal available surface area, such materials can be removed. Materials with an adhesive backing adhere to flat smooth surfaces as a function of surface area. However adhesive backed materials which become attached to the protruding structures contact only the outer surfaces of the ribs, which according to the invention is less than the area of a continuous surface (e.g., a cylinder) at the same position (e.g., radial distance). Such materials are simply peeled away from the outer surfaces of the protruding structures.

Depending on the materials, the adhesive and the dimensions of the radially outward facing surfaces, some adhesive backed materials may be difficult to remove completely, and may tear during removal. The ribs can be spaced apart (e.g., 1–4 cm.) to allow maintenance workers to pass a rake-like tool, or their fingers, through the channels defined between adjacent ribs, to get behind and to remove an affixed poster.

Removal of posters can also be enhanced by spraying water or a solvent into the channels above and generally surrounding the poster. Water or solvent sprayed into the channel above the poster is guided down the channel to the base of the pole. Some of the water or solvent sprayed into the channel contacts the adhesive backed rear surface of the affixed poster. Posters having an essentially waterproof or solvent resistant front surface may be easily removable since the adhesive on the back is softened from behind without the need to tear through outer surface of the poster. Posters having a water soluble adhesive backing will automatically deteriorate and detach from the pole after one or more rain storms.

Figure 4:
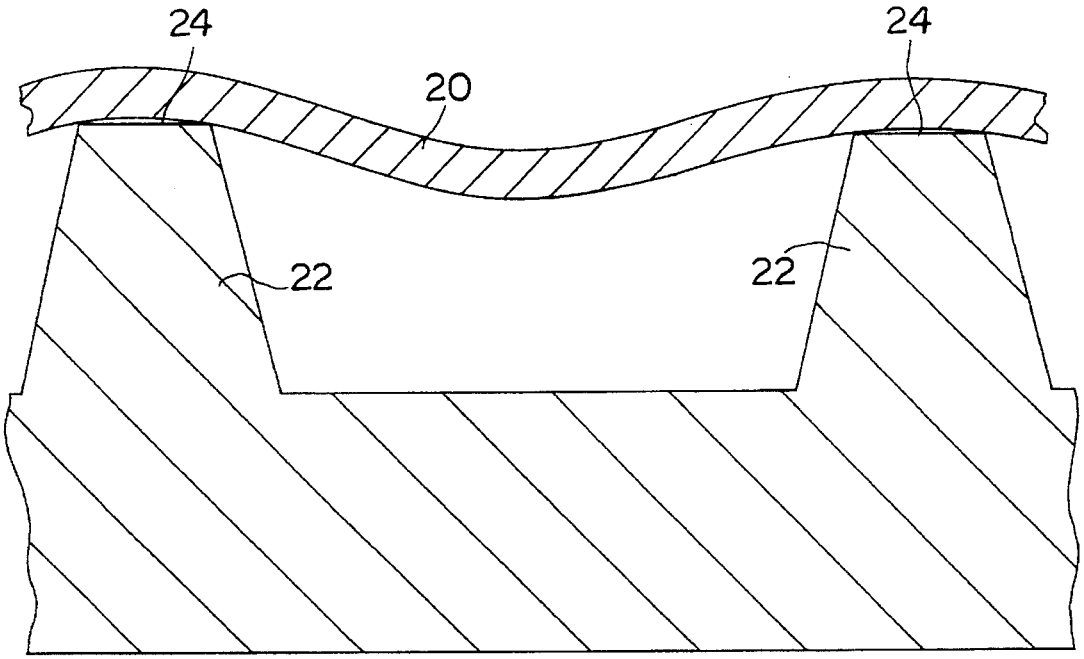

FIG. 4 is a section view showing the extent to which a poster 20 can be attached adhesively to protruding ribs or like structures according to the invention, in this case showing a straight rather than curved section, for example a portion of a rectangular pole. The ribs 22 or the like preferably are tapered in cross section but in any event present an area along their top surfaces 24 that is substantially less than the area of poster 20. The ribs 22 as shown have a top width about one sixth the width of an imaginary surface at the same height. Thus the adhesive attachment is only one sixth of what it would be on a smooth surface. If the protrusions are embodied as truncated pyramids rather than longitudinally continuous ribs (which could also be represented by FIG. 4), the surface area is reduced to one part in thirty six.

Preferably, the protruding ends have an outer facing surface area less than twenty percent of an area of an imaginary smooth surface at a height equal to that of the protruding ends. The particular proportion can vary depending on the extent to which protection from posters is desired, even to the point of making the ribs knife edged. For ease of manufacturing and a strong structure, trapezoidal shapes are preferred.

As shown in FIG. 4, the ribs or other protrusions have a sufficient height that poster 20 cannot readily reach the surface of the pole in the channels defined between ribs 22, and instead poster 20 is suspended between the protruding ends of the ribs 22. For this purpose, the ribs can be spaced from one another and made high enough that a typical poster is too stiff to reach the bottoms of the channels. Moreover, if a particularly tenacious poster hanger presses a very-flexible poster into the channels, the poster will become rippled and visually unsatisfactory, which provides a disincentive. In the embodiment shown in FIG. 4, the ribs or the like are about twice as high as the width of ends 24.

Figure 3:
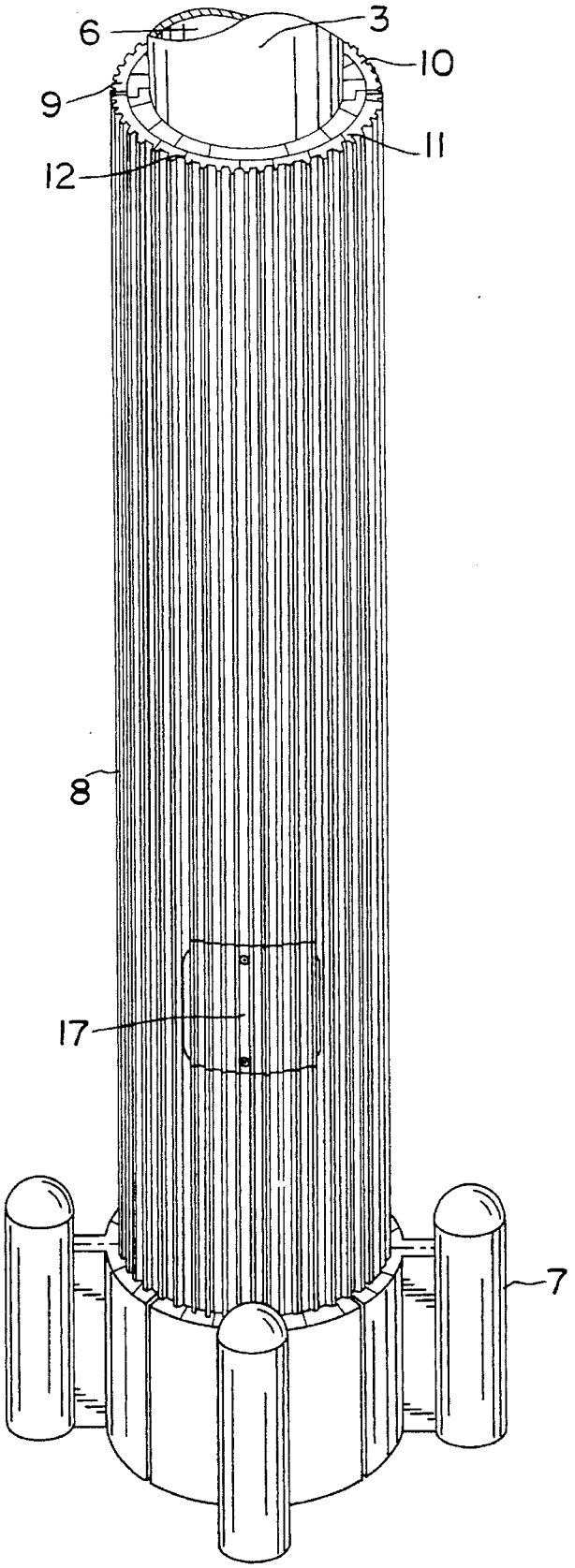
FIG. 3 is a enlarged perspective segment the ribs or splines of the poster resistant pole in detail; and, FIG. 4 is a partial section view showing a poster attached to the poster resistant pole of the invention.

The poster resistant section can be used on solid or hollow core support members. For traffic signal poles, light poles and the like, a hollow interior portion 6 preferably is provided, through which wiring can be routed to lighting fixtures and the like (not shown) which are coupled to the pole in conventional manner. FIG. 3 shows a poster resistant section on a hollow support member. A removable access panel 17 is provided so that the hollow interior portion of the support member can be reached to effect wire fishing, electrical connections and the like.

According to an embodiment suitable for cylindrical structures such as poles, the poster resistant portion is divided along longitudinal lines into semi-circumferential segments. FIG. 3 shows a poster resistant portion divided into four segments 9, 10, 11 and 12, each segment covering a 90° arc on the outer surface of the support member. The poster resistant section is attached to the outer surface of the support member, one segment at a time, using adhesives or fasteners and the like. The poster resistant portion can be attached to the support member before or after the support member is mounted to the base and permanently installed at a location. It is also possible to provide segments that have other angles, such as two opposite segments of 180°, as shown by the inner sleeve in FIG. 3, which as shown can have complementary opposite edges forming lap joints upon assembly. It is also possible to form ribbed sheathing for flat structures, to be mounted adjacent one another to cover the surface, and preferably including lap joint or the like for attaching adjacent panels of sheathing.

The poster resistant structure as discussed above can be applied to support members having a profile other than round, such as rectangular, hexagonal, oval or other geometric shapes. The poster resistant structure can be used as a nonstructural protective covering, or can be an aspect of a structure such as a pole, in which event the ribs or splines contribute to the rigidity and structural strength of the pole or the like.

In the drawings, the backing plate 13 is shown as having a curved profile. However, the backing plate can have a flat profile such that it can be mounted to any flat surface. The invention is suitable for use in conjunction with completely flat surfaces including bridge abutments, exterior walls and the like. Accordingly, terms like "concave" and "convex" are used merely for convenience in describing the preferred application to poles, and is not meant to limit the invention.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A pole comprising an outer surface having a plurality of rigid raised protrusions, defining ribs, along at least a portion of said outer surface, said raised protrusions having outer ends defining a surface area less than an area of an imaginary smooth surface encompassing the outer ends, wherein the ribs are tapered in cross section, the protruding ends have an outer facing surface area less than twenty percent of an area of an imaginary smooth surface at a height equal to that of the protruding ends, and the ribs have a height at least twice a width of the protruding ends, whereby channels are defined between the ribs, and the pole is made resistant to adhesive affixation of sheet materials due to limiting an area available for contact with the sheet materials to said protruding ends and preventing contact between the sheet materials and bottoms of the channels between the ribs.

2. The pole of claim 1 wherein the plurality of raised protrusions comprises longitudinal ribs.

3. The pole of claim 1 wherein the longitudinal ribs are provided on one of a tubular structure and a longitudinally segmented sheath structure.

4. The pole of claim 3 further comprising a non-stick coating on at least the outer ends.

5. The pole of claim 3 wherein the longitudinal ribs have a trapezoidal profile.

6. The pole of claim 1 wherein the outer surface is round profile and the protrusions extend substantially radially.

7. The pole of claim 1 wherein the outer surface is tapered in step like fashion along a longitudinal length of the pole.

8. The pole of claim 1 wherein the outer surface is continuously tapered.

9. The pole of claim 1 wherein the outer surface has a solid core integral with the protrusions.

10. The pole of claim 1 wherein the outer surface is formed with a hollow core integral with the protrusions, thereby defining an interior portion.

11. The pole of claim 10 wherein the outer surface is formed with an access opening to the interior portion, and further comprising a removable panel which covers the access opening.

12. A poster resistant pole comprising a support member and a backing plate having a plurality of rigid longitudinal ribs extending from the backing plate to protruding ends, the backing plate being coupled to the exterior surface of the support member and covering at least a portion of the outer surface of the support member to be rendered resistant to adhesive attachment of sheet materials, said longitudinal ribs being tapered in cross section, the protruding ends having an outer facing surface area less than twenty percent of an area of an imaginary smooth surface at a height equal to that of the protruding ends, and the ribs having a height at least twice a width of the protruding ends, thereby limiting an area available for contact of said sheet materials to the protruding ends of the ribs and preventing contact between the sheet materials and bottoms of the channels between the ribs.

13. The poster resistant pole of claim 12 wherein the backing plate comprises at least two attachable sections that are fittable by at least one of axially telescoping interconnection and adjacent longitudinal joints.

14. The poster resistant pole of claim 12 wherein the backing plate is fittable over the support member and the support member has a smooth outer surface engageable against the backing plate.

15. The pole of claim 12 wherein the ribs are trapezoidal in cross section and the protruding ends have a contact width about one sixth of a width of the imaginary smooth surface.

16. A poster resistant sheath comprising an outer surface having a plurality of rigid raised protrusions, defining ribs, along at least a portion of said outer surface, said raised protrusions having outer ends defining a surface area less than an area of an imaginary smooth surface encompassing the outer ends, wherein the ribs are tapered in cross section, the protruding ends have an outer facing surface area less than twenty percent of an area of an imaginary smooth surface at a height equal to that of the protruding ends, and the ribs have a height at least twice a width of the protruding ends, whereby channels are defined between the ribs, and the pole is made resistant to adhesive affixation of sheet materials due to limiting an area available for contact with the sheet materials to said protruding ends and preventing contact between the sheet materials and bottoms of the channels between the ribs.

17. The poster resistant sheath of claim 16 wherein the plurality of raised protrusions comprises longitudinal ribs.

18. The poster resistant sheath of claim 16 wherein the longitudinal ribs are provided on one of a flat structure and a tubular structure and a longitudinally segmented sheath structure.

19. The poster resistant sheath of claim 16 further comprising a non-stick coating on at least the outer ends.

20. The poster resistant sheath of claim 16 wherein the longitudinal ribs have a trapezoidal profile.

21. The poster resistant sheath of claim 16 wherein the outer surface is round profile and the protrusions extend substantially radially.

22. The poster resistant sheath of claim 16 wherein the outer surface is flat and the protrusions extend substantially perpendicular to the outer surface.

* * * * *